US005655025A

United States Patent [19]

Kim et al.

[11] Patent Number: 5,655,025

[45] Date of Patent: Aug. 5, 1997

[54] CIRCUIT FOR AUTOMATICALLY RECOGNIZING AND RECEIVING MONO AND STEREO AUDIO SIGNALS

[75] Inventors: Sung-soo Kim, Anyang; Young-gyoo Choi; Noh-byung Park, both of Suwon, all of Rep. of Korea

[73] Assignee: Samsung Electronics Co., Ltd., Kyungki-do, Rep. of Korea

[21] Appl. No.: 441,296

[22] Filed: May 15, 1995

[30] Foreign Application Priority Data

Oct. 27, 1994 [KR] Rep. of Korea ..... 94-27700

[51] Int. Cl.[6] ..... H04H 5/00

[52] U.S. Cl. ..... 381/11; 381/12; 381/123; 381/28

[58] Field of Search ..... 381/1, 11, 12, 381/123, 74, 25, 28

[56] References Cited

U.S. PATENT DOCUMENTS 4,433,209 2/1984 Kurosawa ..... 381/25

5,056,148 10/1991 Hayashi ..... 381/25

*Primary Examiner*—Minsun Oh

*Attorney, Agent, or Firm*—Rothwell, Figg, Ernst & Kurz

[57] ABSTRACT

In a mono/stereo input circuit for use in an audio equipment, and more particularly in a circuit for automatically recognizing and receiving mono/stereo audio signals, although a mono connector is inserted into a stereo jack, such an insertion of the mono connector is automatically recognized and then a stereo circuit can operate as a form of a mono circuit. The circuit for automatically recognizing and receiving the mono/stereo audio signals utilizes a fact that one connection terminal of the jack is grounded or not according to a type of the connector such as a mono connector and a stereo connector which is inserted into the jack. Accordingly, a resistor used as a voltage generator generates a generation voltage according to such a connector recognition. Also, using a difference between the generated voltage, the analog switches are turned on or off, to obtain a mono or a stereo audio signal processing circuit according to a type of the inserted connector. Accordingly, the present invention has an effect that a type of the inserted connector can be automatically recognized, and an external source or a microphone input circuit can operate without having any inconveniences to change a selector switch each time when a user exchanges a stereo input signal with a mono input signal.

4 Claims, 3 Drawing Sheets

CIRCUIT FOR AUTOMATICALLY RECOGNIZING AND RECEIVING MONO AND STEREO AUDIO SIGNALS

BACKGROUND OF THE INVENTION

The present invention relates to a mono/stereo input circuit for use in audio equipment, and more particularly, to a circuit for automatically recognizing and receiving mono and stereo audio signals, in which, although a mono connector is inserted into a stereo jack, such an insertion is automatically recognized so that a stereo circuit can operate for mono sound.

FIG. 1 is a circuit diagram of a conventional mono/stereo audio input circuit. In FIG. 1, a microphone connector such as a mono input connector (FIG. 3) or a stereo input connector (FIG. 4) is inserted into a stereo jack 1 having left and right terminals 1L and 1R and a ground terminal. Stereo jack 1 transmits an audio input signal supplied via the inserted microphone connector to a next stage. A mono/stereo selector 2 selects an audio processing circuit included in an amplifier portion 3, by which a mono or stereo audio input signal is transmitted to the proper audio processing circuit according to the type (mono or stereo) of the inserted microphone connector. Amplifier portion 3 amplifies the mono or stereo signal according to a mode selected by selector 2, and outputs the amplified signal to another amplifier stage or a speaker circuit via output terminals 4R and 4L. In FIG. 1, C1 through C7 and R1 through R5 are capacitors and resistors, respectively.

When a mono input is supplied to a circuit configured as above such that a mono connector (FIG. 3) is connected to stereo jack 1, left terminal 1L is connected to a signal portion 15 of the mono connector, which is proper, but right terminal 1R of stereo jack 1 is improperly connected to ground portion 12. As a result, the right input is grounded and only the left input signal is transmitted.

To prevent such a phenomenon and recover the right signal line, the mono/stereo selector 2 is used to disconnect ground portion 12 of the mono connector from amplifier portion 3 and tie the input of the right signal line to that of the left signal line by switching a switching blade SW to the left signal line, so that the mono signal input is fed through both left and right circuits. Thus, the stereo audio apparatus operates as a mono circuit.

In operating the conventional mono/stereo audio input circuit constructed as above, the position of selector 2 must be switched manually to the proper setting, whenever changing from a mono input condition to a stereo input condition, or vice versa, which represents an inconvenience to the user.

SUMMARY OF THE INVENTION

To solve the above problems, it is an object of the present invention to provide a circuit for automatically recognizing and receiving mono and stereo audio signals, in which a mono or a stereo connector, that is, a type of a connector which is inserted into a stereo jack is automatically recognized and an input signal transmitted via the inserted connector is transmitted to an audio processing circuit in a next stage to match the type of the connector.

To accomplish the above object according to the present invention, there is provided a circuit for automatically recognizing and receiving mono/stereo audio signals comprising: connection means for connecting a signal connector from a microphone or an external source; connector type discrimination means for discriminating a type of the connector when a mono or a stereo connector is inserted into the connection means; and switching means for altering a signal line according to the connector type discriminated in the connector type discrimination means.

In this embodiment, it is desirable that the connector type discrimination means comprises voltage generation means for generating a respective different voltage according to a type of the inserted connector, and inverter means for inverting the generated voltage.

It is desirable that the voltage generation means is formed of a resistor.

It is desirable that the switching means is formed of an analog switch which is turned on or off according to the generation voltage and a high or low level of the inverter means.

BRIEF DESCRIPTION OF THE DRAWINGS

Further features and advantages of the present invention will become more apparent from the following description, reference being made to accompanying drawings wherein a preferred embodiment of present invention is clearly shown.

In the drawings.

DETAILED DESCRIPTION OF THE INVENTION

A preferred embodiment of a circuit for automatically recognizing and receiving mono and stereo audio signals according to the present invention will be described below with reference to the accompanying drawings.

Figure 1:
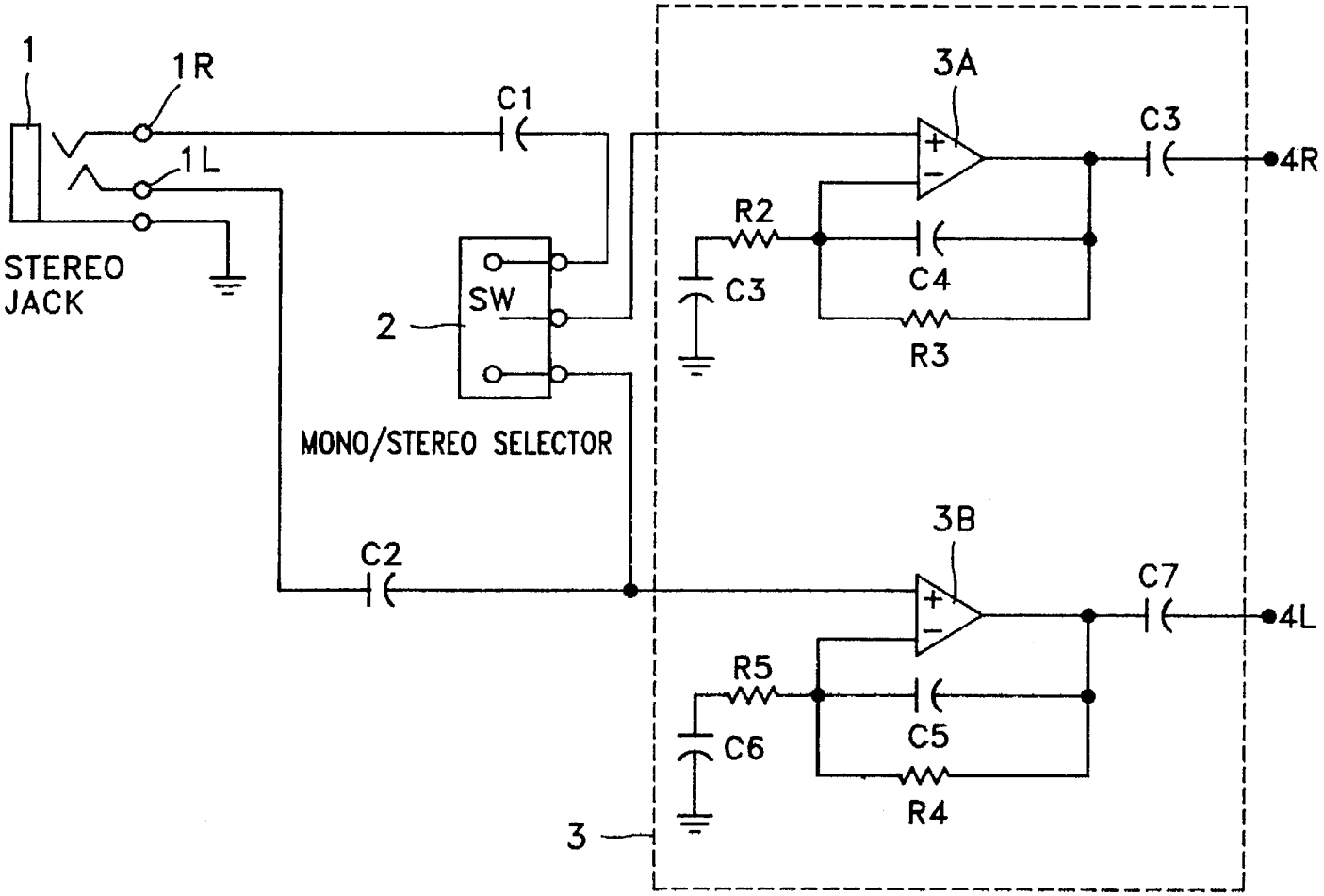
FIG.1(PRIOR ART)
FIG. 1 is a circuit diagram of a conventional mono/stereo audio input circuit.
Figure 2:
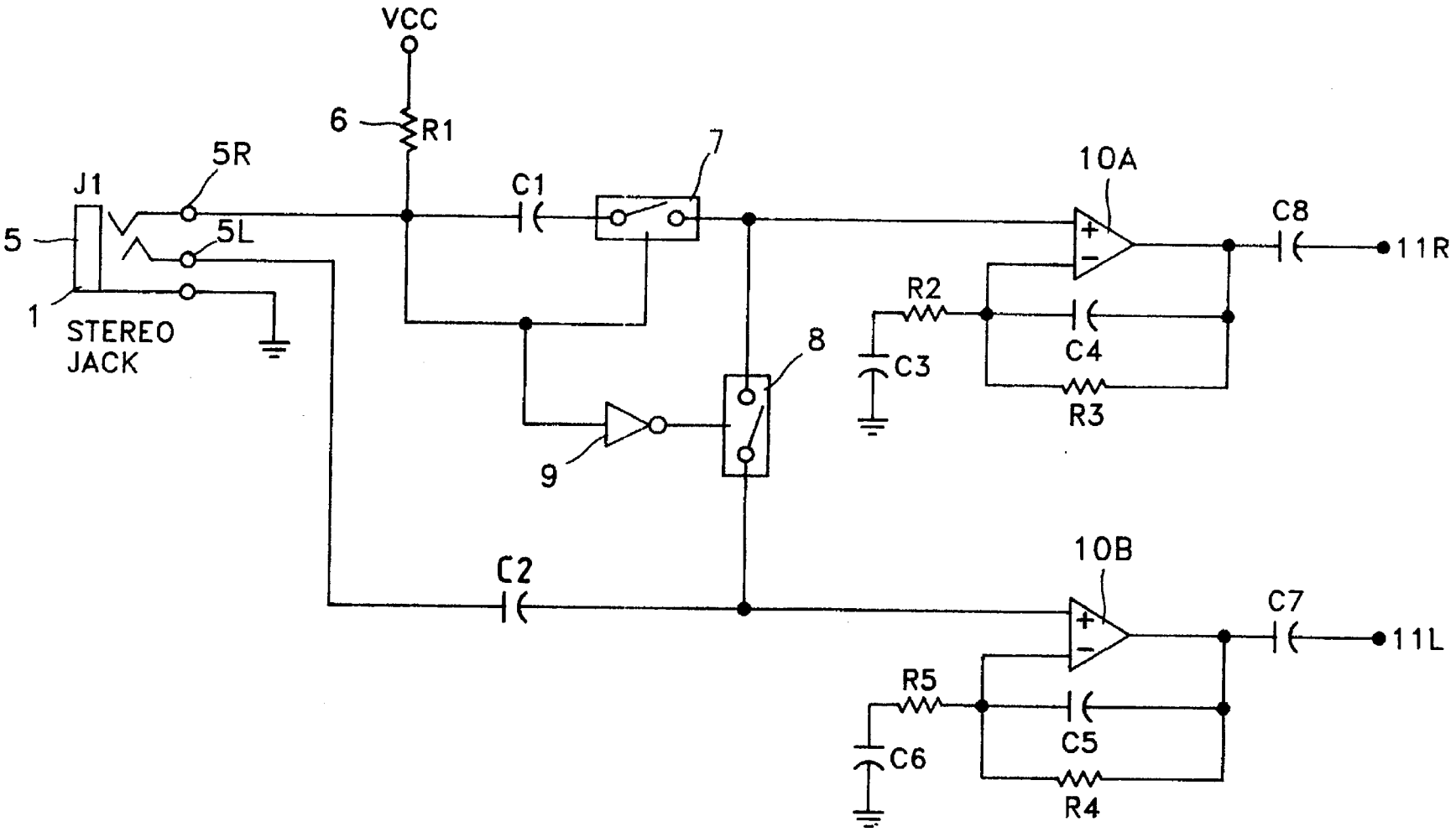
FIG. 2 is a circuit diagram of a mono/stereo audio input circuit according to the present invention.
Figure 3:
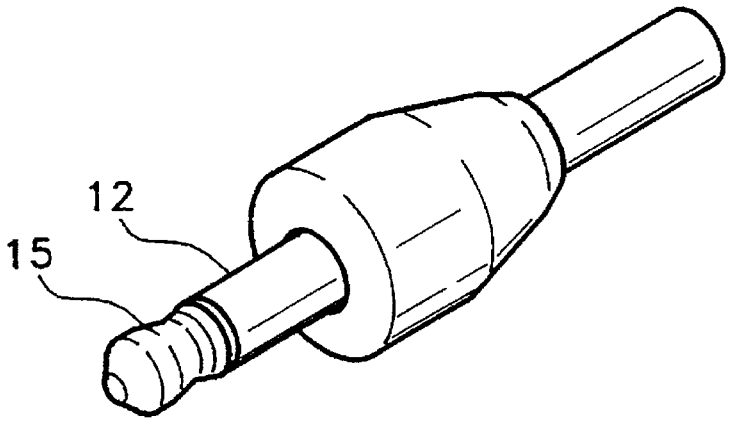
FIG.3(PRIOR ART)
FIG. 3 is a perspective view of a mono input connector.
Figure 4:
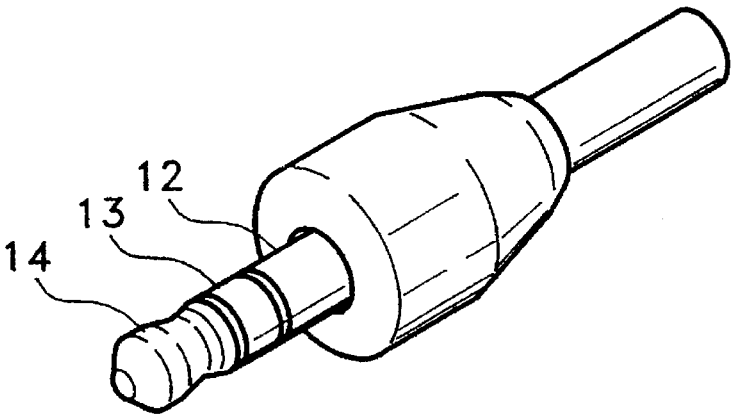
FIG.4(PRIOR ART)
FIG. 4 is a perspective view of a stereo input connector.

FIG. 2 is a circuit diagram of a mono/stereo audio input circuit according to the present invention. In FIG. 2, the mono/stereo audio input portion includes a voltage generator 6 for generating a high or low voltage according to a type of an inserted input connector when a mono or a stereo input connector respectively shown in FIGS. 3 and 4 is inserted therein, two analog switches 7 and 8 for turning on or off an input/output according to the generation voltage of voltage generator 6, an inverter gate 9 for inverting the generation voltage of voltage generator 6 which is located in front of analog switch 8 which is connected between input ends of left and right amplifiers, among the two analog switches 7 and 8, and amplifiers 10A and 10B for amplifying a mono or a stereo signal selected by switches 7 and 8. The output ends 11R and 11L thereof are connected to another amplifier or other speaker circuit.

Such a circuit for automatically recognizing and receiving mono/stereo audio signals operates as follows.

When a stereo connector as shown in FIG. 4 is inserted into stereo jack 5, a left terminal portion 14 of the connector is connected to a left terminal 5L of jack 5, while a right terminal portion 13 of the connector is connected to a right terminal 5R of jack 5. Thus, the voltage of right terminal 5R of jack 5 becomes operating voltage Vcc, and the Vcc voltage is applied to a control terminal of analog switch 7. Therefore, the input end and the output end of the analog switch 7 are connected to each other to thereby turn on the analog switch. On the other hand, the Vcc voltage of right terminal 5R is inverted by inverter gate 9, to become a zero voltage which is input to a control end of analog switch 8. Accordingly, analog switch 8 becomes in an open state. Therefore, the input ends of the right and left amplifiers 10A and 10B are separately from each other. The input signal transmitted to left terminal 5L of jack 5 is transmitted to left amplifier 10B, while the input signal transmitted to left terminal 5R of jack 5 is transmitted to right amplifier 10A, to output a stereo audio signal.

When a mono connector as shown in FIG. 3 is inserted into jack 5, a signal portion 15 of the connector is connected to left terminal 5L of jack 5, while a ground portion 12 of the connector is connected to right terminal 5R of jack 5 to ground right terminal 5R. Thus, the voltage of right terminal 5R of jack 5 becomes a ground voltage (zero voltage). Also, zero voltage is applied to a control end of analog switch 7. Accordingly, the input and output ends of analog switch 7 becomes in an open state. Thus, the input signal applied to right terminal 5R of jack 5 cannot be transmitted to right amplifier 10A. On the other hand, the zero ground voltage of right terminal 5R is inverted by inverter gate 9 to become in operating voltage Vcc. Accordingly, the Vcc voltage is applied to a control end of analog switch 8 which is located between the input ends of right and left amplifiers 10A and 10B, to enable analog switch 8 to become in an on-state. Therefore, the input end of right amplifier 10A is connected to that of left amplifier 10B. Accordingly, the input signal transmitted to left terminal 5L of jack 5 is transmitted to right and left amplifiers 10A and 10B, thereby outputting a mono audio signal.

As described above, the circuit for automatically recognizing and receiving the mono/stereo audio signals according to the present invention utilizes a fact that one connection terminal of the jack is grounded or not according to a type of the connector such as a mono connector and a stereo connector which is inserted into the jack. Accordingly, a resistor used as a voltage generator generates a generation voltage according to such a connector recognition. Also, using a difference between the generated voltage, the analog switches are turned on or off, to obtain a mono or a stereo audio signal processing circuit according to a type of the inserted connector. Accordingly, the present invention has an effect that a type of the inserted connector can be automatically recognized, and an external source or a microphone input circuit can operate without having any inconveniences to change a selector switch each time when a user exchanges a stereo input signal with a mono input signal, and vice versa.

What is claimed is:

1. A method for recognizing and processing mono and stereo audio signals processed by a conventional mono/stereo audio jack having left and right terminals and a ground terminal, the method comprising the steps of:

providing either an operating voltage or ground to a right signal line according to whether a signal received by said jack is a stereo signal or a mono signal;

operating a first switch to a closed position which couples the right terminal to said right signal line when the voltage on said right terminal is the operating voltage;

operating a second switch in a manner opposite that of said first switch such that when such said first switch is in an open position said second switch is in a closed position and when said first switch is in a closed position said second switch is in an open position, said second switch coupling the left terminal to the right signal line when it is in a closed position.

2. A circuit for automatically recognizing and receiving mono and stereo signals, comprising:

a mono/stereo jack having a left terminal, a right terminal, and a ground terminal;

a connector-type discriminator which generates a signal indicative of whether a connector inserted in said jack is a stereo or mono connector;

a first switch which couples said right terminal to a right amplifier when said connector-type discriminator generates a signal indicating that the inserted connector is a stereo type;

a second switch which connects said left terminal to said right amplifier when said connector-type discriminator generates a signal indicating that the inserted connector is a mono type.

3. A circuit according to claim 2, wherein said connector-type discriminator includes voltage generation means for generating a discriminating voltage signal and an inverted discriminating voltage signal in accordance with the type of connector received by said jack, said voltage generation means including a resistor and an inverter connected to said resistor.

4. A circuit for automatically recognizing and processing mono and stereo audio signals according to claim 3, wherein said first and second switches are operated in accordance with the output of said voltage generation means.

* * * * *